United States Patent [19]

Eisenberg

[11] 4,047,594

[45] Sept. 13, 1977

[54] SCAFFOLD AND PLATFORM ADAPTABLE FOR ASSEMBLY AND DISASSEMBLY

[76] Inventor: Hans Jochen Eisenberg, Wettiner Str. 47a, 5600 Wuppertal 2, Germany

[21] Appl. No.: 686,879

[22] Filed: May 17, 1976

[30] Foreign Application Priority Data

Feb. 27, 1976 Germany ..... 2608060

[51] Int. Cl.[2] ..... E04G 1/18

[52] U.S. Cl. ..... 182/153; 182/179; 182/181; 182/222

[58] Field of Search ..... 182/179, 178, 152, 153, 182/181–185, 224, 225, 141, 222, 223; 52/66, 126, 109

[56] References Cited

U.S. PATENT DOCUMENTS

| | | | |
|---|---|---|---|
| 2,775,490 | 12/1956 | Hofrichter | 182/223 |
| 2,806,747 | 9/1957 | Jaeger | 182/179 |

FOREIGN PATENT DOCUMENTS

| | | | |
|---|---|---|---|
| 342,018 | 1/1931 | United Kingdom | 182/179 |
| 768,979 | 2/1957 | United Kingdom | 182/152 |

*Primary Examiner*—Reinaldo P. Machado

[57] ABSTRACT

A scaffold and platform adaptable for assembly and disassembly consisting of similar rectangular platform blocks functioning together as lateral beams, each provided with upper and lower frames which are each adjustable manually as to height and which are supported always by means of two scissor members on the two opposite longitudinal sides, whereby the legs of the scissors are articulated with one end at a corner point of the lower frame, and can be arrested at their other upper end at the lateral beams of the upper frames in different positions, being characterized by intermediate slabs which are attachable at their upper frames and are insertable between the longitudinal sides of the platform blocks and wherein said intermediate slabs are joined to the middle longitudinal area of the upper frame-lateral beams of the platform block by attaching elements, which engage with the adjusting path of the upper ends of the legs of the scissors and limit the adjustment of height of the platform blocks to a permissible minimum height.

5 Claims, 11 Drawing Figures

SCAFFOLD AND PLATFORM ADAPTABLE FOR ASSEMBLY AND DISASSEMBLY

CROSS REFERENCE TO RELATED APPLICATIONS

Applicant makes reference to his West German Patent Application P 26 08 060.4 filed Feb. 27, 1976 under which priority is claimed under the provisions of 35 USC 119.

BACKGROUND OF THE INVENTION

1. Field of the Invention

The invention relates to a scaffold and platform adaptable for assembly and disassembly, which consists of similar rectangular platform blocks provided with upper and lower frames and adjustable manually in height, which are supported always by way of two scissor members on two opposite longitudinal sides, whereby the legs of the scissors are articulated with one end at a corner point and can be stopped or arrested at their other upper end in different positions on lateral cross beams of the upper frame.

2. Description of the Prior Art

Such platform blocks as are supported by way of scissors for the variable formation of scaffoldings and platforms have been known in th prior art, for example, from the German patent 23 05 145. Such known platform blocks are disposed directly side by side and are adjustable always to the desired level, whereby they are mutually interlocked. In this case, the stability of the platform blocks must be selected corresponding to the area of the specific load carrying capacity of the scaffolding platform, whereby, however it is to be noted that in the case of platform blocks which are provided with scissors, that the carrying capacity of the platform blocks depends on the pertinent height or level of the platform blocks. Obviously, with an increasing obliquity of the legs of the scissors, that is to say with a decreasing height or level of the platform blocks, a more favorable leverage conditions exist. In order to guarantee for all adjustments in height that the prescribed minimum carrying capacity is maintained, the platform block will have to be mechanically developed such, that it will have the prescribed carrying capacity even in the case of the lowest height adjustment of the scissors, which perforce leads to the result, that in the case of higher adjustments of the platform block, an unnecessarily high carrying capacity must exist. In the case of the numerous cases of application, where the platform blocks are adjusted to great heights across the greatest or the entire area of the scaffolding, the use of the known platform blocks will lead to an unnecessary expenditure.

OBJECT OF THE INVENTION

Therefore, the invention is based on the task and object of utilizing the described excessive stability of platform blocks adjusted to considerable height for a lowering of the overall expenditure of scaffolding platforms.

SUMMARY OF THE INVENTION

According to the invention, the solution of this task has been achieved by intermediate slabs attachable at the upper frame and insertable between the longitudinal sides of the platform blocks. By these intermediate slabs, one will achieve on the one hand the advantage that essentially fewer platform blocks will have to be used for areas of the scaffolding that are to be adjusted to a high level, by for example disposing platform blocks and intermediate slabs alternatingly side by side. Since the intermediate slabs are considerably cheaper than the platform blocks which are adjustable as to height, the initial costs for a scaffolding and platform adaptable for assembly and disassembly will be reduced considerably. Further, much greater space-saving storage possibilities exist for a disassembled scaffolding platform in accordance with the invention, since the intermediate slabs have a considerably lower storage height than the completely folded up platform blocks.

In view of the generally limited storage spaces, this space-saving storability is of decisive and of practical significance in these "limited storage" situations. In correspondence with the low level and the slight weight of the intermediate slabs, one can also accomplish their transportation to and from the site more quickly, so that the novel scaffolding platform is also distinguished by the possibility of a quicker assembly and disassembly.

In a further development of the invention provisions can be made, that the intermediate slabs are connected to the middle, longitudinal area of the lateral cross beams of the upper frame of the platform block through attaching members, which engage with the adjusting path of the upper ends of the legs of the scissors and which limit the adjustment in height of the platform blocks to a permissible minimum height. As a result of this, it will be ensured that the intermediate slabs cannot be inserted erroneously between platform blocks which are adjusted to such a low level that an intermediate insertion of intermediate slabs is no longer permissible for reasons of load capacity.

Additional characteristics of the invention, which related to the shape of the intermediate slabs and an effective development of the attaching means for connection of the intermediate slabs to the platform blocks are cited in the claims herein.

BRIEF DESCRIPTION OF THE DRAWING

The other objects of the invention will be explained in more detail in the following pages on the basis of an embodiment shown in the drawing.

DESCRIPTION OF THE PREFERRED EMBODIMENTS

Figure 1:
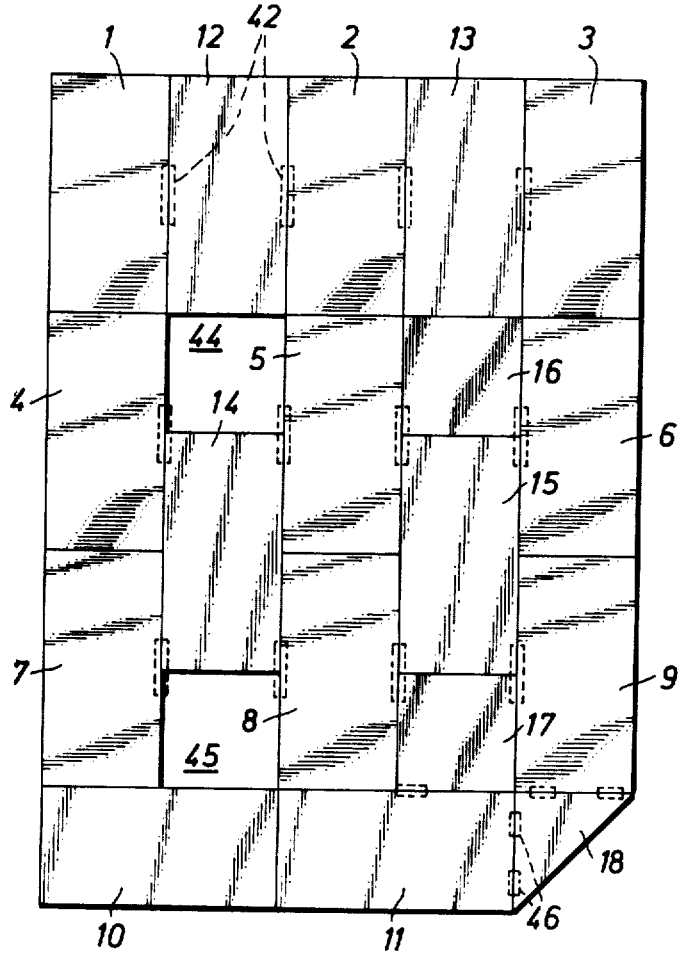
FIG. 1 shows a scaffold and platform erected from platform blocks and intermediate slabs adjustable as to height.

FIG. 1 shows in top view a scaffolding platform that can be assembled and disassembled, which has been built up of platform blocks 1 and 11 adjustable as to height, rectangular intermediate slabs 12 and 15 inclusive, and square intermediate slabs 16, 17, as well as a triangular intermediate slab 18.

Figure 2:
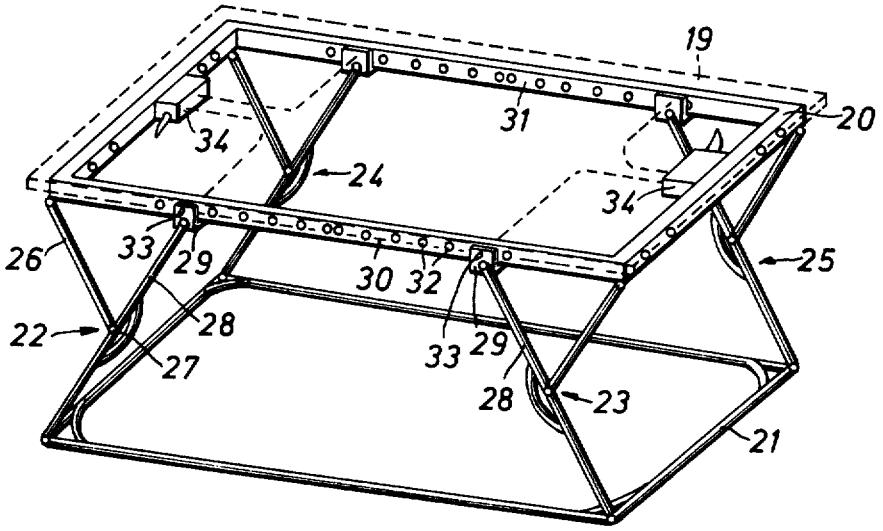
FIG. 2 shows a platform block, the platform of which is supported by scissors that can be adjusted in height.

The platform blocks 1 to 11 have been developed identically and they, together with the rectangular, square and triangular intermediate slabs have the structure shown in FIG. 2 consisting of a platform 19 and is shown in FIG. 2 in a broken line over rectangular upper frame 20 at the top which is over rectangular bottom frame 21 both frames being of the plan form of the platform block, The upper frame 20 and lower frame 21 are articulated with their two scissor legs in the area of the two corner points of the upper frame 20 and the bottom frame 21. The upper and bottom frames are disposed on top of one another. As in the case of every scissors, the left front leg 26 is articulated at the corner point of the upper frame 20 and terminates in the point of cross 27 of the two legs 26, 28 of the scissors, whereby the crossing point lies in the longitudinal mid point of the longer leg 28, and the shorter leg 26 is one half the length of the longer leg. The platform block is developed symmetrically in relation to its perpendicular, transverse central plane as well as in relation to its perpendicular, longitudinal middle plane, and the platform 19 has, in a simple case, a dimension of 1 meter × 2 meters. Thus the relationship of the short side to the long side of the platform is 1 to 2 and the square intermediate slabs have a relationship to the rectangular intermediate slabs of 1 to 2 in respect to their longest side as is evident in FIG. 1.

The upper end of the longer legs 28 are articulated to slide 29 which is guided slideably on the lateral cross beam 30, respectively 31 of the upper frame and can be arrested in various positions defined by engaging apertures 32 of the lateral cross beams. The slides 29 each have a spring-loaded engaging bolt 33, and the bolts on the slide can be pulled out by way of a Bowden wire adjusting mechanism 34 from the pertinent engaging aperture 32. As FIG. 2 clearly shows in the case of lowering of the platform 19, the two slides 29 move toward each other at each lateral cross beam 30, 31.

Figure 3:
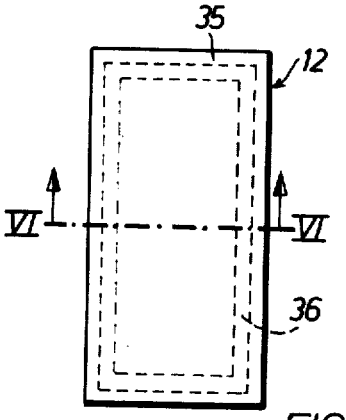
FIG. 3 shows in top view a first embodiment of an intermediate slab.
Figure 5:
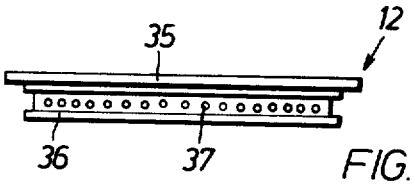
FIG. 5 is a side view of the intermediate slab according to FIG. 3.
Figure 6:
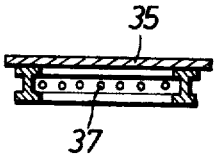
FIG. 6 is a cut following the lines VI—VI in FIGS. 3 and 4.

The intermediate slabs 12 to 15 have the structure shown in FIGS. 3, 5 and 6, and consist of a platform 35 and a rectangular supporting frame 36, whereby advantageously these slabs are developed identically to the platform 19 and the upper frame 20 of the scaffolding platform. The supporting frame 36 has been provided at all sides with holes 37 for the accommodation of the attaching screws. The supporting frame 36 and the upper frame 19, in the case of the embodiment shown by way of example, have an I-profile (See FIG. 6), so that the frames have on the outside and the inside a U-channel in the middle of the I open toward the outside.

Figure 4:
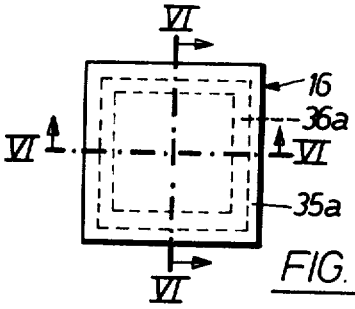
FIG. 4 is a second embodiment of an intermediate slab.

FIG. 4 shows a square intermediate slab 16, the lateral length is equal to the width of the platform 19 of the platform blocks. Otherwise the slab 16 according to FIG. 4 has been structured in the same way as the intermediate slab according to FIG. 3 from a platform 35*a* supporting frame 36*a*.

Figure 7:
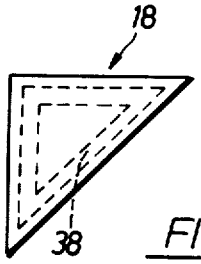
FIG. 7 is a triangular intermediate slab in top view.
Figure 8:
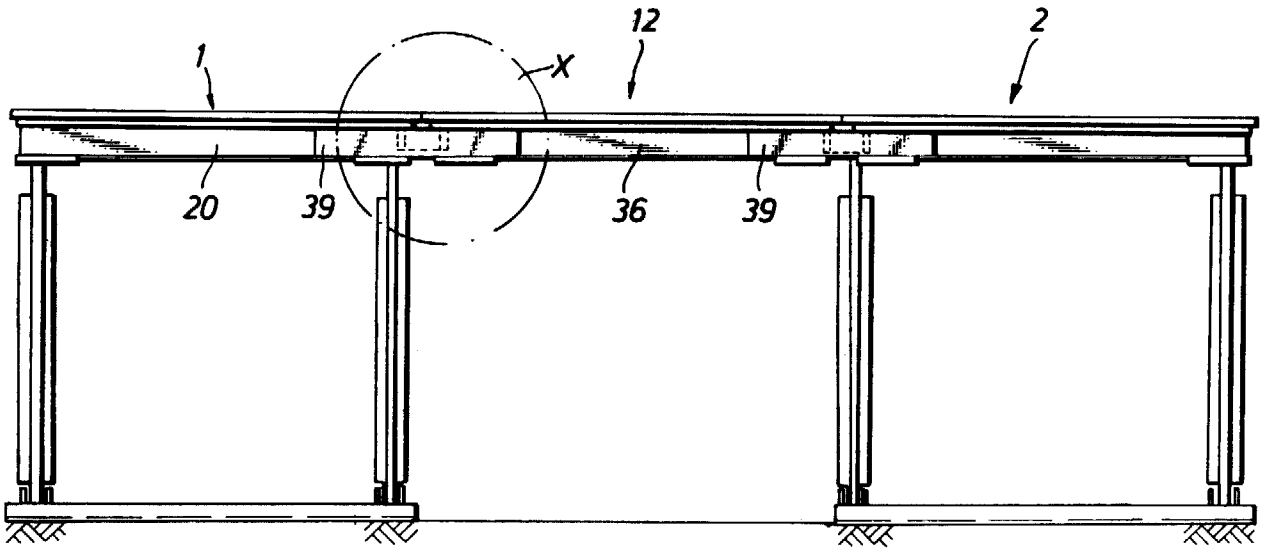
FIG. 8 is a front view of two platform blocks with an intermediate slab disposed in between in transverse alignment.

FIG. 7 shows still further in top view a right angle isosceles triangular slab 18, in the case of which the length of the side of the leg of such a triangle is equal to the width of the platform 19 of the platform blocks. This slab, too, is provided with a supporting frame 38 with an I-profile.

In the case of the embodiment according to FIG. 1, in the upper row the platform blocks 1, 2, 3 and intermediate slabs 12, 13 are aligned in the transverse direction and are disposed in alternating manner with their longitudinal sides side by side, which are interconnected at their front ends by way of slab-shaped bars 39 (see also FIGS. 8 to 11) and are also interconnected by additional attaching members in the area of their longitudinal mid points as shown in FIG. 1. The bars 39 used at the front ends consist of a steel plate, which bars are inserted with tight clearance into the outer U-channels of an adjacent I-member of the platform part or block of the upper frame 20. The supporting frame 36 is adapted to connection to the intermediate slabs by bolts which have been welded on the slabs e.g. and screw bolts 40 and which are put through corresponding hole 32 on one side and 37 of the other side of adjacent frame 20. To tighten the intermediate slabs to frame 36 and are tightened wing nuts 41 are used on bolt 40 and attention is invited to the view in FIGS. 10 and 11.

Figure 9:
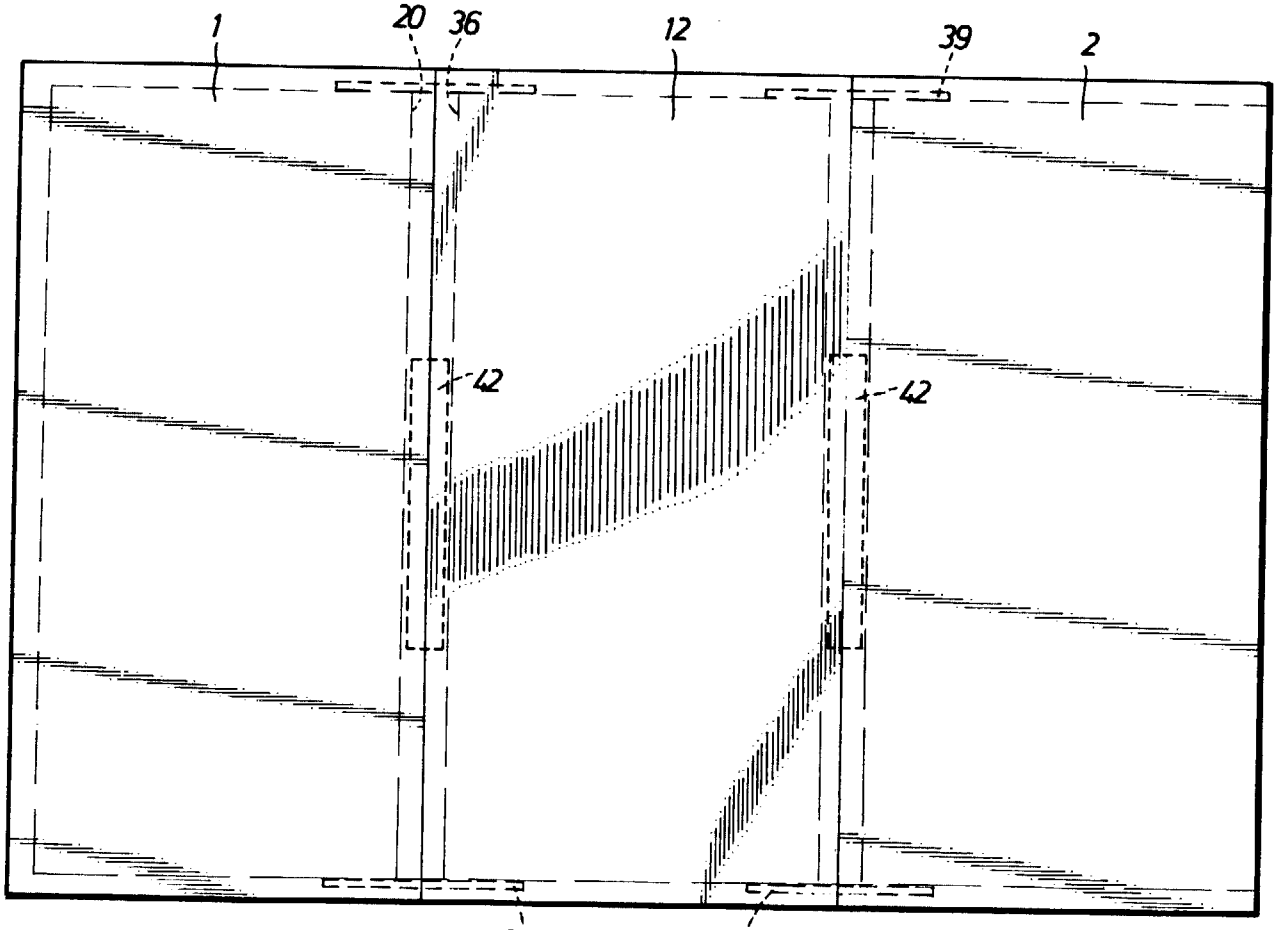
FIG. 9 is a top view of FIG. 8.
Figure 10:
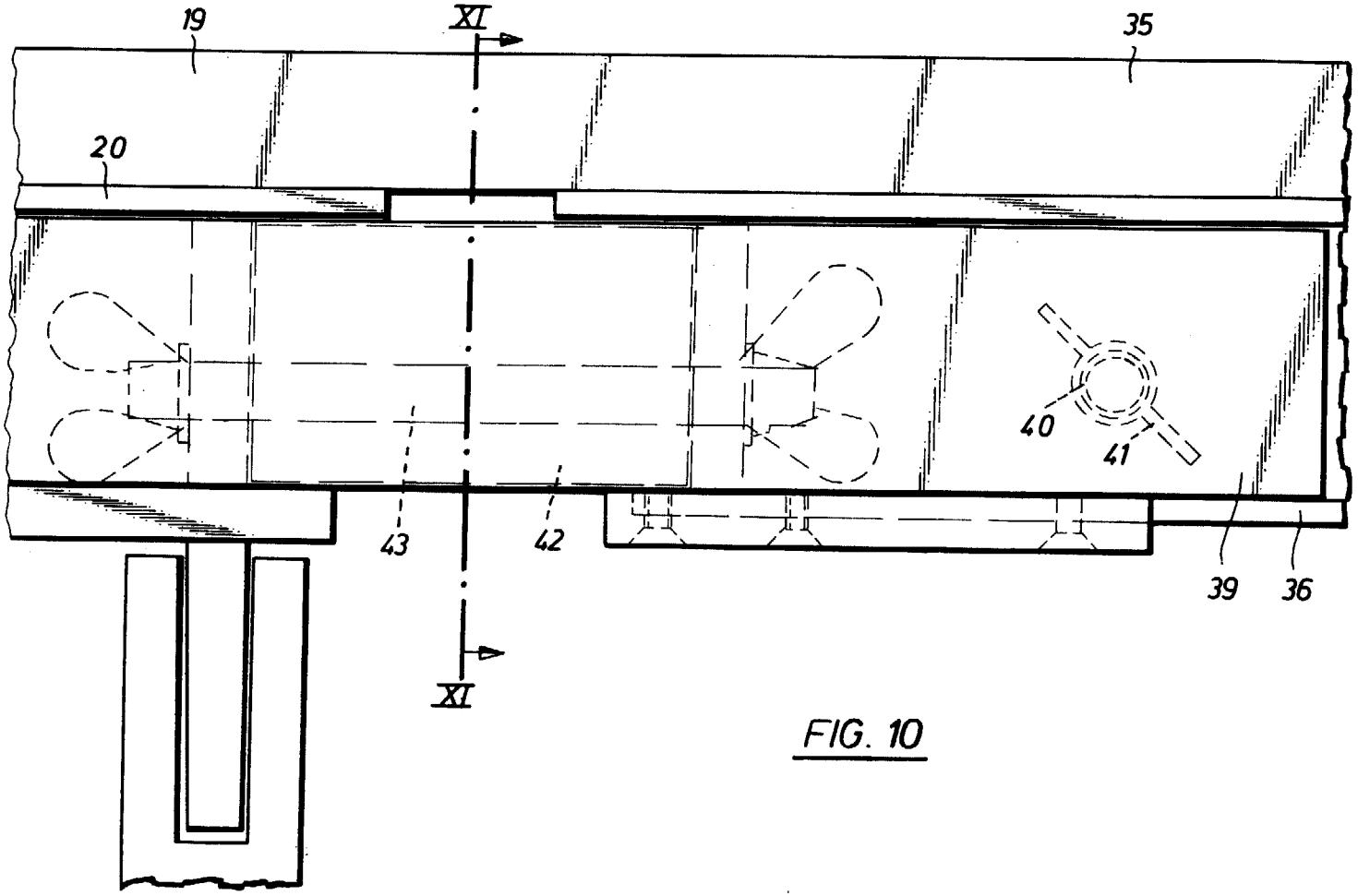
FIG. 10 shows a detail area X from FIG. 8 at an enlarged scale and FIG. 11 shows a cut following the lines XI—XI in FIG. 10.
Figure 11:
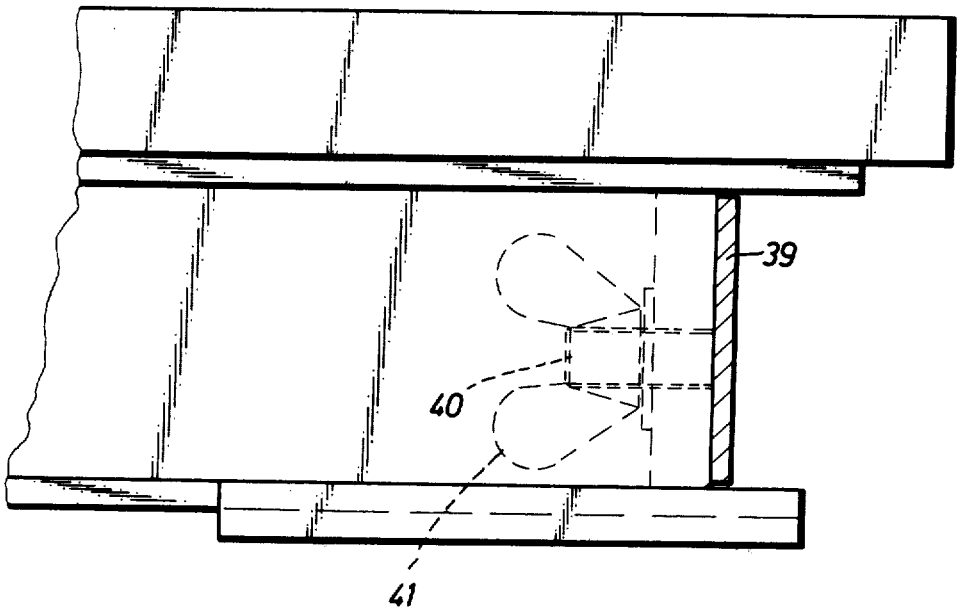

As becomes clear particularly from FIGS. 9 and 10, the attaching members disposed in the longitudinal middle of the scaffolding platforms comprises structural beams, for example, of wood, which can be inserted with clearance into the U-channels of adjacent upper frames 20 and supporting frames 36, through which penetrate screw bolts 43 bracing the two frames 20, 36. The plates (beams) 42 are located in the path of adjustment of the slides 26 and are of such a length, that a certain minimum distance between the two slides 26 on the one lateral beam 30 or 31 and thus a certain minimum height of the platform block cannot be understepped.

As is further shown in FIG. 1 with the example of the platform blocks 4 to 9, the intemediate slabs 14, 15 can also be inserted — displaced by half their length — always between two pairs of platform blocks, whereby now holes 37 disposed at the ends of the lateral beans of the supporting frames 36 are utilized for attachment. In the case of this displaced arrangement, the platform blocks 4 to 9 are braced both in a transverse as well as in a longitudinal direction of the scaffolding automatically by the inserted intermediate plates 14, 15, so that the otherwise customary means for a mutual bracing of all platform blocks are unnecessary.

Whereas square openings 44, 45 are left open between the platform blocks 4, 5 respectively 7 and 8, square slabs 16, 17 according to FIG. 4 are disposed at corresponding places between platform blocks 5/6 and 8/9, which slabs are attached in the area of the longitudinal middle of the adjacent platform blocks again with the use of plates 42 and in the area of the front ends of platform blocks with the use of plate-shaped bars 39. The triangular intermediate slab 18, also shown in FIG. 1, is attached at the front sides of the two platform blocks 9, 11 disposed at right angle to one another, with the use of coupling beams 46 inserted into the frame profiles and with the use of tightening screws 43.

As has been indicated only by way of example in FIG. 1, the intermediate plates 12 to 18 increase the possibility of variation for the structure of a scaffolding platform, whereby the overall expenditure has been considerably lowered and only few simply shaped attaching means are required for the attachment of the intermediate slabs, which means at the same time take over the task of the overall bracing of all scaffolding platform elements mutually, so that the otherwise necessary bracing means are omitted.

What is claimed is:

1. A scaffolding and platform adapted for assembly and disassembly and for adjusting as to height consisting essentially of a plurality of similar rectangular platform blocks each provided with a lower frame, an upper frame, a rectangular platform carried by the upper frame and four scissors for the four corners of the platform, said scissors being arranged in pairs on the two longitudinal sides of the platform blocks, each scissor having two legs, one leg of each scissor being articulated with one end at one of the four corner points of the lower frame whereas the other end of said one leg is slidable on one of the two longitudinal sides of the upper frame and arrested by stop means at different points of the longitudinal side of the upper frame for adjusting the height of the platform, a number of rectangular intermediate slabs having the same plan form as the platform blocks, said intermediate slabs being attached at the longitudinal sides of the upper frames of neighboring platform blocks, attaching elements for inserting between the longitudinal sides of the slabs and of the upper frame, said attaching elements being arranged at the middle section of the longitudinal sides of the upper frame of the blocks and limiting the displaceability of the slidable ends of one of said scissor legs, thus guaranteeing a minimum height of the platform blocks when slabs are inserted in the scaffolding.

2. A scaffolding and platform as claimed in claim 1, wherein the slabs consist of an intermediate platform and of an intermediate supporting frame and wherein the upper frame and the supporting frame each have an I-profile with a U-part open toward the outside and wherein in that said attaching elements comprise a bar element insertable into the adjacent U-part of the I-profile of the longitudinal side of the upper frame and the supporting frame, said bar element being penetrated by screw bolts connecting the upper frame with the supporting frame.

3. A scaffolding and platform as claimed in claim 1, wherein the supporting frame made of lateral beams and transverse beams, which are provided in their longitudinal middle as well as at their terminal sections with holes for the accommodation of said screw bolts and for accommodation of the intermediate slabs which may be inserted either in a transverse direction and aligned between two platform blocks or may be displaced by half a length always between platform blocks disposed to the right and to the left.

4. A scaffolding and platform as in claim 2, wherein plate-shaped transverse bars are provided which are insertable into the U-parts of the transverse side beams of the platform block-upper frames and intermediate slab-supporting frames, and wherein bolts are provided so that said bars can be bolted together with the frames.

5. A scaffolding and platform as in claim 1, wherein additional, intermediate slabs are provided with a supporting frame having screw holes, which slabs have a square or an isosceles triangular outline and in the case of the triangle, the length of the sides is equal to the width of the platform block-platform.

* * * * *